United States Patent [19]

Lee

[11] 4,178,783

[45] Dec. 18, 1979

[54] YIELDABLE LOCK LATCH FOR FIRE EXTINGUISHER CABINET

[76] Inventor: Walter F. Lee, Bloomington, Minn.

[21] Appl. No.: 839,826

[22] Filed: Oct. 6, 1977

[51] Int. Cl.[2] ..... E05B 15/16

[52] U.S. Cl. ..... 70/422

[58] Field of Search ..... 70/422, 78, 81; 292/DIG. 65, DIG. 71, 76, 77

[56] References Cited

U.S. PATENT DOCUMENTS

| | | | |
|---|---|---|---|
| 2,255,402 | 9/1941 | Vile | 292/78 |
| 2,859,430 | 11/1958 | O'Callaghan | 70/422 |
| 3,083,046 | 3/1963 | Eberly | 292/76 |
| 3,540,766 | 11/1970 | Hoffman | 292/76 |
| 3,797,871 | 3/1974 | Monishita | 292/DIG. 65 |
| 3,801,143 | 4/1974 | Gutner | 292/76 |

FOREIGN PATENT DOCUMENTS

| | | | |
|---|---|---|---|
| 584751 | 1/1947 | United Kingdom | 70/422 |

*Primary Examiner*—Robert L. Wolfe
*Attorney, Agent, or Firm*—Wicks & Nemer

[57] ABSTRACT

A door latch for a fire extinguisher cabinet including in combination a cabinet having a hinge mounted door. A lock is mounted on the door with the lock having a latch extending therefrom engageable with a portion of the cabinet, the latch made of yieldable material whereby when the door is pulled outwardly of the cabinet the latch yields and bypasses the portion of the cabinet thereby allowing an opening of the door.

1 Claim, 4 Drawing Figures

YIELDABLE LOCK LATCH FOR FIRE EXTINGUISHER CABINET

SUMMARY

The invention relates broadly to an improvement in a lock for a fire extinguisher cabinet and more particularly to a lock which allows for opening the cabinet by a person requiring the extinguisher for emergency use but without a key for the lock. The lock includes a yieldable latch on a conventional tumbler lock whereby as the door of the cabinet is pulled open the lock latch yields thereby allowing opening of the door.

While the cabinet can be gotten into by a thief to steal the fire extinguisher, it allows a locked cabinet but with entry for use of the extinguisher in an emergency, but which requires a positive act to open the cabinet by the yieldable lock latch. The lock deters vandalism but allows an opening of the cabinet in an emergency.

The invention will appear more clearly from the following detailed description when taken in connection with the accompanying drawings, showing by way of example preferred embodiments of the inventive idea wherein like numerals refer to like parts throughout.

In the drawings forming part of this application:

Figure 1:
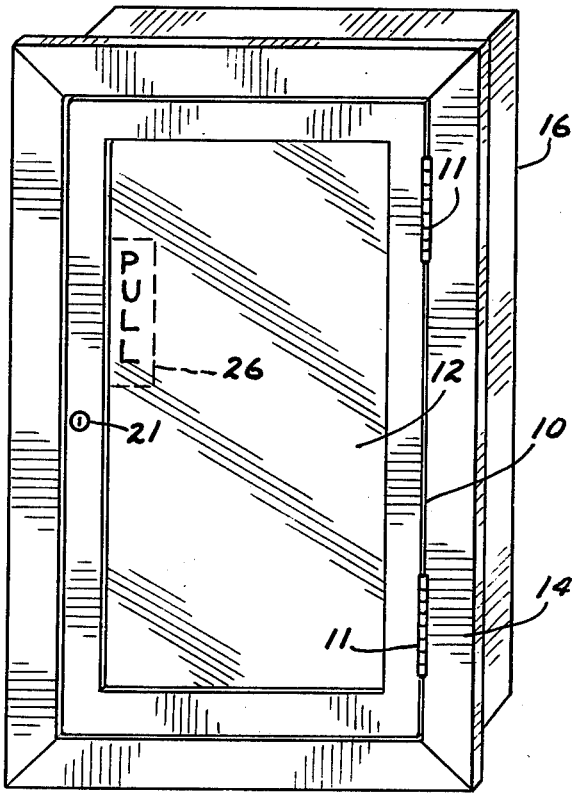
FIG. 1 is a perspective view of a fire extinguisher cabinet having a yieldable door latch embodying the invention.

Referring to the drawings in detail, the yieldable latch A is mounted in the vertical door frame member 10 in which is mounted the glass 12. The door frome 10 is hingedly mounted by means of hinges 11 in the jam frame 14 which is secured to the cabinet box formation 16. The box formation has mounted therein a fire extinguisher, not shown. Mounted in a hole in the frame 10 by means of the flange 19 and the nut 20, is the conventional tumbler lock 21 openable by the key 22. The numeral 23 designates a latch which is secured to the inner end of the lock 21 by means of the bolt 24.

Figure 2:
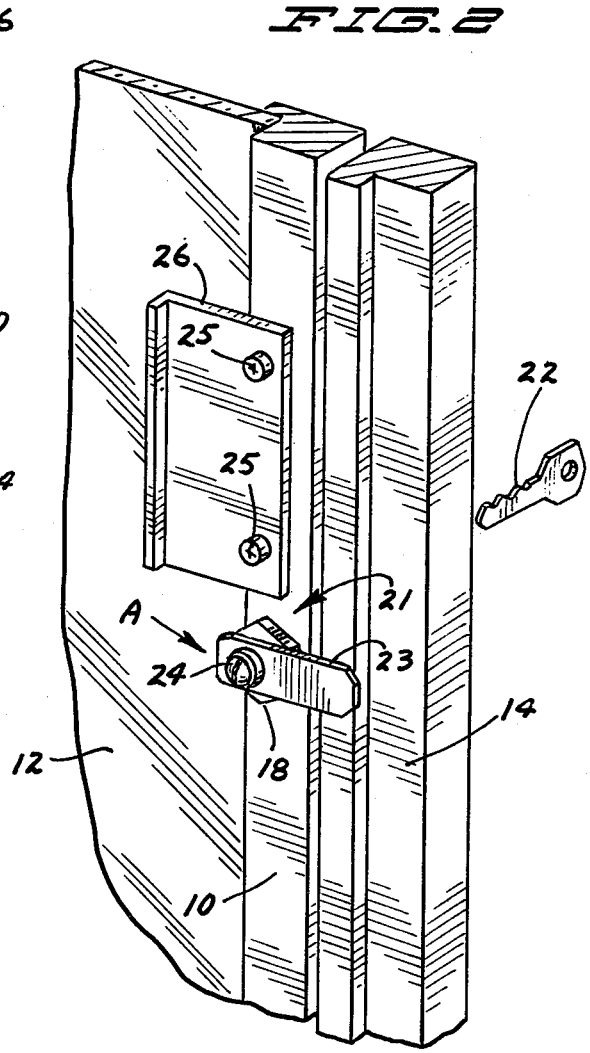
FIG. 2 is an enlarged perspective view of the lock and latch with protions of the door and jam shown.
Figure 3:
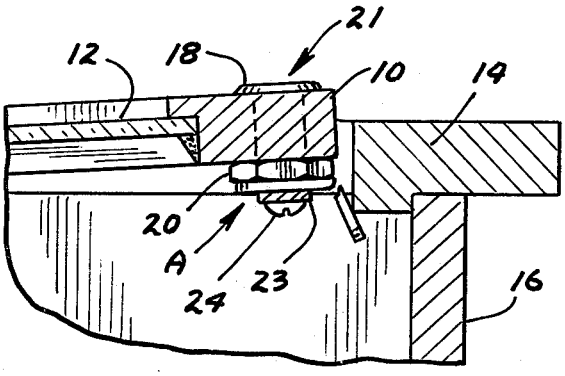
FIG. 3 is a sectional view through the door and jam with the yieldable latch shown as frangible and broken upon opening the door.

The latch 22 is a flat piece of frangible plastic and of a length to engage the jam frame 14 when the lock 21 is locked, particularly FIG. 2. Secured to the inside of the frame 10 adjacent the lock 21 by means of the screws 25 is the pull plate 26.

When a fire extinguisher is needed from the locked cabinet 16 by one who does not have a key to the cabinet, the glass 12 is broken and the pull plate pulled upon. As a result the frangible latch is forced against the frame 14 and is broken. As a result the door may be opened to give access to a fire extinguisher in the cabinet.

Figure 4:
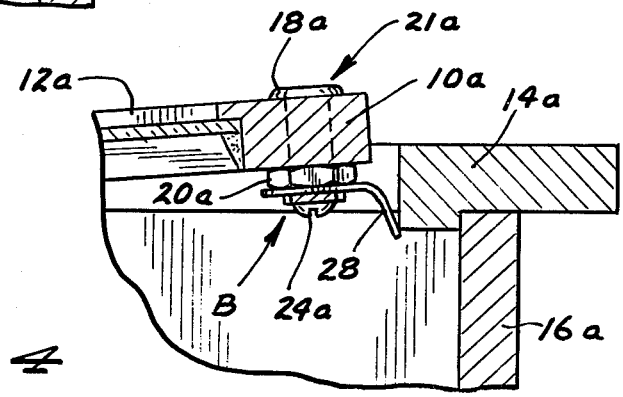
FIG. 4 is a sectional view similar to FIG. 3 but with the latch shown as yieldable.

Illustrated in FIG. 5 is a further embodiment of the latch invention wherein like parts bear identical reference numerals but accompanied by a lower case letter a. The latch B of FIG. 4 consists of a flat piece of metal or bendable plastic 28 similar in shape to the latch 23 and of a thinness that it will bend and bypass the frame 14 as the door is opened as theretofore described and particularly illustrated in FIG. 4. The door may be closed and the latch 28 used again by forcing and bending the latch upwardly sufficiently so that it engages the inside of the jam frame 14*a*.

Having thus described the invention, what is claimed as new and desired to be secured by Letters Patent is:

1. A door latch for a fire extinguisher cabinet comprising in combination:

(a) an enclosure having a hinge mounted (b) door, (c) a lock mounted on said door and having, (d) a latch extending therefrom and engageable with a portion of said enclosure to secure the door in a closed position upon the enclosure, (e) said latch made of yieldable material whereby when said door is pulled outwardly of the enclosure said latch yields and bypasses said portion of said enclosure to allow an opening of said lock, said yieldable latch constructed of frangible plastic.

* * * * *